United States Patent [19]

Brunner

[11] Patent Number: 4,538,934

[45] Date of Patent: Sep. 3, 1985

[54] AUTOMATIC LEAD ADVANCING MECHANISM FOR A MECHANICAL PENCIL

[75] Inventor: Engelbert Brunner, Zirndorf, Fed. Rep. of Germany

[73] Assignee: J. S. Staedtler KG, Nuremberg, Fed. Rep. of Germany

[21] Appl. No.: 520,634

[22] Filed: Aug. 5, 1983

[30] Foreign Application Priority Data

Aug. 7, 1982 [DE] Fed. Rep. of Germany ..... 3229497
Apr. 21, 1983 [DE] Fed. Rep. of Germany ..... 3314452

[51] Int. Cl.[3] ..... B43K 21/22; B43K 21/20

[52] U.S. Cl. ..... 401/53; 401/65; 401/67; 401/80; 401/81; 401/94

[58] Field of Search ..... 401/53, 80, 81, 65, 401/67, 94

[56] References Cited

U.S. PATENT DOCUMENTS

| | | | |
|---|---|---|---|
| 1,700,246 | 1/1929 | Woelm | 401/65 |
| 1,759,931 | 5/1930 | Barberon | 401/67 |
| 2,452,907 | 11/1948 | Collura | 401/65 |
| 3,424,535 | 1/1969 | Schischkow . | |
| 3,864,046 | 2/1975 | Butka . | |

FOREIGN PATENT DOCUMENTS

| | | | |
|---|---|---|---|
| 2153400 | 5/1973 | Fed. Rep. of Germany . | |
| 2611608 | 5/1979 | Fed. Rep. of Germany . | |
| 2837586 | 3/1980 | Fed. Rep. of Germany | 401/65 |
| 3112869 | 2/1982 | Fed. Rep. of Germany . | |
| 3032200 | 3/1982 | Fed. Rep. of Germany | 401/81 |
| 449576 | 6/1936 | United Kingdom | 401/67 |

*Primary Examiner*—Steven A. Bratlie
*Attorney, Agent, or Firm*—Edmund M. Jaskiewicz

[57] ABSTRACT

An automatic lead advancing mechanism for a mechanical pencil has at its writing point a lead guide tube which is movable axially against a clamping member to cause radially movable components of the clamping member to clamp the lead therein during the writing position of the pencil. The lead guide tube moves axially inwardly against a force exerted by a compression spring interposed between the clamping member and a thrust member, a portion of which is engaged by the lead guide tube and another portion of which has a beveled surface engaging a correspondingly beveled surface on the clamping member. The co-acting beveled surfaces exert both axial and radial forces to the clamping member.

18 Claims, 15 Drawing Figures

AUTOMATIC LEAD ADVANCING MECHANISM FOR A MECHANICAL PENCIL

The present invention relates to an automatic lead advancing device for a mechanical pencil, more particularly, to such a device which will advance a supply of lead therethrough as required without adjustment by the user.

Such mechanical pencils have a writing point in which a lead guide tube is axially movable and protrudes therefrom carrying a lead which can then be applied against a surface during writing. When the pencil is pressed downwardly against a surface in the writing position, the lead guide tube and the lead will move axially inwardly against a clamping member and close the clamping member so as to retain the lead firmly in position to resist writing pressure. When the pencil is lifted from the writing surface, the lead guide tube is moved downwardly through the writing point under the effect of a spring at which time the lead held by the lead brake also moves forwardly while at the same time the clamping member opens so that the lead is released from it.

One such mechanical pencil is disclosed in DE-OS No. 30 32 200. However, this pencil has the disadvantage that since the compression spring which is located between the lead guide tube and the clamping claw is in constant operative connection, the clamping claw and the lead may adhere to each other after long periods of non-use of the pencil or the lead may tend to cold breakage so that functional breakdowns in the pencil will occur. Further, there must be a very precise and exact relationship between the length and strength of the compression spring and of the other interacting components. As a result, production of such a pencil becomes quite difficult and expensive.

Another form of mechanical pencil is disclosed in DE-AS No. 26 11 608 in which the clamping member has transverse elements or claws on its front side directed to the writing point and in which an axially movable sleeve is fastened to the lead guide tube. The lead guide tube is pressed to the writing position by a spring located on the lead guide tube while a second spring exerts an opposite force on the clamping member. Similarly, a very precise relationship is necessary between the two springs and a special thrust bearing is required for the clamping member. In addition, no automatic supply of lead is possible. New lead is supplied by actuating a push member as a result of which the clamping device is manually opened so that a new lead can be grasped by the jaws of the clamping member.

In U.S. Pat. No. 3,424,535, there is disclosed a pencil which has several clamping claws or jaws which intermesh. Cross or transverse members extend out from the front side and a compression spring is arranged around them. On the one hand, the compression spring works directly on the one clamping claw and on the other hand, works directly on the lead guide tube. The resulting structure is a very complex and expensive pencil which is also susceptible to breakdown because of the intricate relationship of the many intermeshing components.

DE-OS No. 21 53 400 and U.S. Pat. No. 3,864,046 disclosed two additional pencils each having a lead supply between the axially movable lead guide tube and the compression spring located on the clamping member. These structures also have the disadvantage that the clamping and spring device is very complicated and difficult to adjust and is also susceptible to mechanical failure because of the many interacting parts.

Additional prior art pencils of the general nature to which the present invention relates are disclosed in German Patent No. 28 37 586 and DE-OS No. 31 12 869.

It is thus the principal object of the present invention to provide a novel and improved automatic lead advancing device for a mechanical pencil.

It is another object of the present invention to provide such an automatic lead advancing device which can be constructed with relatively large axial tolerances especially in the region of the writing point without adversely influencing the writing properties of the pencil.

It is a further object of the present invention to provide such an automatic lead advancing device which can be produced at reasonable costs, is reliable in operation, and which retains the lead with a minimum of pressure particularly in the rest or non-writing position so that writing can be performed for long periods of time without any additional manipulations of the pencil.

The advantages of the present invention are achieved and the disadvantages of the prior art are eliminated by providing on the front side of the clamping member directed toward the writing point a number of axially extending arms and inwardly directed stop claws on the ends of these arms and a compression spring positioned between the clamping member and stop claws in a direction parallel to the pencil axis. Since this compression spring is operatively connected by at least one contact point to transmit both radial and axial forces directly or indirectly to the stop claws and also connected operatively by a contact surface with the lead guide tube or a portion thereof, it is a relatively simple matter to equalize production tolerances such that the individual components can be produced in relatively simple manufacturing operations and at the same time provide for sufficient clearance or play to enable the mechanism to operate properly and effectively. At the same time, the clamping member performs its clamping function in a very positive and effective way so as to enable the pencil to operate reliably for long periods of time and at the same time a reliable supply of lead is achieved which is not susceptible to malfunctioning. The contact point between the compression spring and the stop claws is so constructed that the axially directed force of the compression spring is converted into axial and radial force components and both force components cause a radial opening of the clamping member such that the clamping member is continously open when the pencil is in the rest or non-writing position. Thus, in the rest position, the first lead is unclamped in the clamping member but held in position by the lead brake. Successive leads can then readily fall through the clamping member to the end of the first lead in order to achieve a reliable and automatic supply of lead.

According to one aspect of the present invention, an automatic lead advancing device for a mechanical pencil may comprise an axially movable lead guide tube and an axial movable clamping member having radially movable components to clamp a lead passing through a central passage thereof. A plurality of arms project axially from the face of the clamping member directed to the writing point of the pencil and there are inwardly directed stop claws on the ends of the axial arms. A compression spring is disposed within the axial arms and has one end acting upon the clamping member and the other end acting against means which are operatively connected to the lead guide tube, means are provided to transmit both radial and axial forces of the spring to the clamping member so that the clamping member is in an unclamping position with respect to a lead passing there through when the pencil is in a non-writing position.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
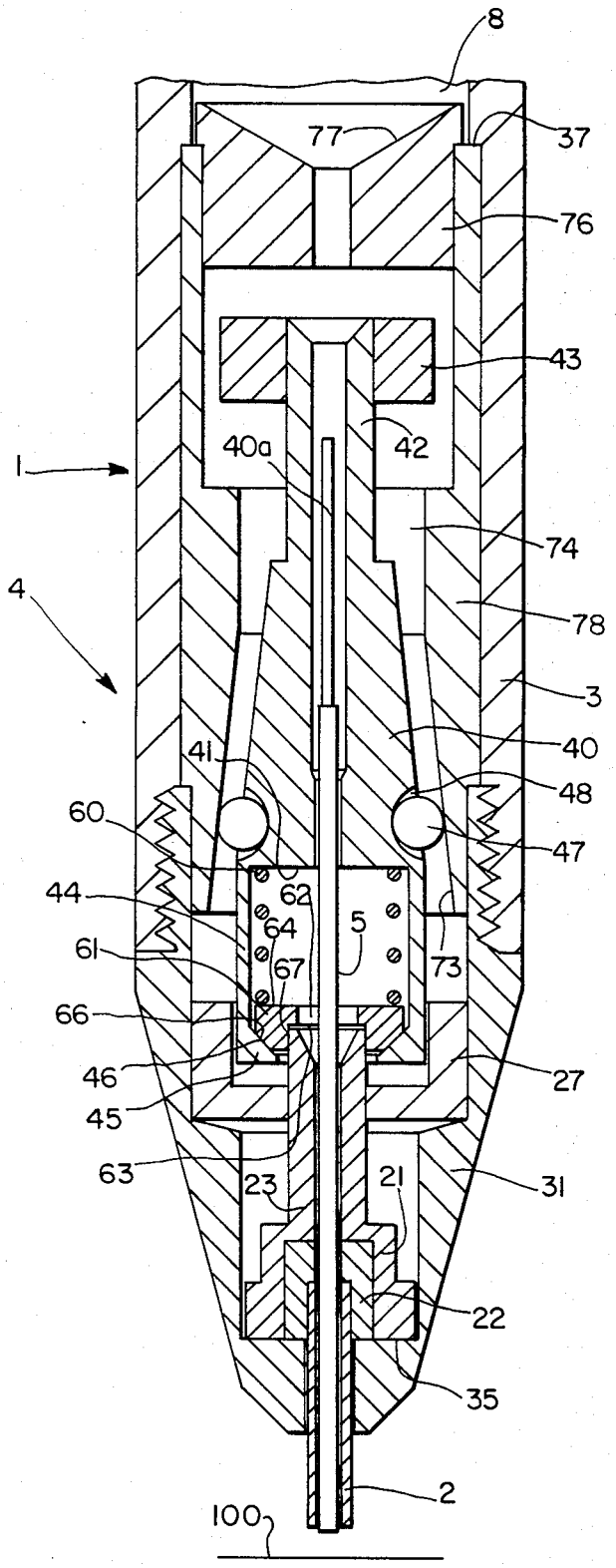
FIG. 1 is a longitudinal sectional view of the writing or front portion of a pencil incorporating the present invention and illustrated in the rest or non-writing position.

In FIG. 1, there is illustrated generally at 1 a mechanical pencil incorporating the present invention and in the rest or non-writing position. The pencil 1 has a casing or housing 3 in which a sleeve 78 is secured therein against axial movement by a shoulder 37 formed in the inner surface of the casing 3 and contacting the upper end of sleeve 78 and at its lower end by an inner edge of a writing point 31 which is threaded into the lower end of the casing 3. The upper end of the sleeve 78 is closed by a cap 76 provided with a central bore and an inwardly beveled surface 77 which is directed toward compartment 8 in the upper end of the casing within which pencil leads are stored.

At the lower portion of the inner surface of sleeve 78 is a conical surface 73 and the upper portion of the sleeve 78 has a widened bore.

A clamping member 40 is axially movable within the sleeve 78 and has at its upper end a shaft 42 on the extreme end of which is mounted an annular collar weight which functions as a safety device to limit the downward axial movement of the clamping member and also provides additional weight to permit proper functioning of the clamping member. The clamping member 40 is provided with a plurality of longitudinally extending slots **40*a* to divide the member into two or more radially movable jaws which are radially flexible or resilient and are shown in the open position in FIG. 1. These jaws are interconnected at the upper end of the shaft 42 or may be constructed of a number of individual jaw elements or segments. Inner faces of the jaws are spaced closely from the lead when in the open position as shown in FIG. 1 and these surfaces constitute the clamping or gripping members. The clamping member 40** may be made of a metal, such as brass, or of a relatively hard plastic.

The outer surface of the clamping member 40 is provided with a plurality of recesses 48 each of which are positioned rollers 47 which are engageable with the conical surface 73.

The clamping member has a front face 41 which is directed toward the writing point and extending axially from the periphery of the front face is a plurality of axially extending arms 44 which are rigid with respect to the clamping members. The ends of the arms 44 are each provided with radially inwardly directed stop claws 45, the upper or inner faces of which are provided with a conical stop surface 46. The axial arms 44 are preferably perpendicular to the clamping member surface 41 and should be rigid and resistent to bending so that radial forces of a compression spring, to be presently described, are transmitted as completely as possible onto the stop surfaces 46 of the clamping member.

Within the axially extending arms 44 is a compression spring 60 which acts axially, on the one hand, between the front face 41 of the clamping member 40 and, on the other hand, on the rear side 64 of a thrust member 61 so that the side 64 functions as a spring stop. The thrust member 61 has a force exerting beveled surface 66 on its side directed to the stop claws 44 and surround a central bore 62 thereof is a contact surface 63 which functions as a centering device 67 for the rear end of a contact attachment 23. In the rest position of the pencil, when the pencil is lifted from surface 100 there is preferably a slight play or clearance between the contact surface 63 and the upper surface of the contact attachment 23.

In the writing point 31 there is disposed an axially movable cylindrical insert member 21 the lower end of which is supported upon a stop shoulder 35 formed in the interior of writing point 31. The insert 21 is also provided with a lead brake or chuck 22 preferably formed of a resilient or elastic material so as to exert a degree of axial holding force on the lead therein.

From the upper end of the insert 21 extends the tubular contact attachment 23 and extending from the lower portion of the insert 21 is a lead guide tube 2 which in its rest position projects just outwardly of the writing point to its maximum projection and is firmly connected with the lead brake 22 and insert 21. An end stop 27 is firmly secured in the upper end of the writing point 31 to function as a safety or precaution against falling out of the clamping device indicated generally at 4 when the pencil is disassembled. At the same time, the stop 27 provides an upper limit to axial movement of the slidable insert 21 and a lower limit to movement of the claws 45 on the clamping member 4.

The radially inwardly extending claws 45 provide a base for the compression spring 60 either directly or through a thrust member 61 as illustrated and may also function as an upper axial limit to the writing point. The stop claws 45 together with the compression spring 60 and thrust member 61 distributes an axial force exerted by the spring 60 into an axial force and to a radial spreading force which is preferably somewhat weaker than the axial force. The co-acting bevel surfaces on the thrust member 61 and the claws 45 are preferably at about 45°.

In the embodiment of FIG. 1, the compression spring 60 acts upon a thrust member 61 which in turn transmits force to the claws 45. However, the compression spring may act directly upon the bevel surfaces 66 of the claws through a pressure insert member so that there is a non-locking contact region between the spring and the stop claws. The axial arms 44 and the claws 45 are arranged around the compression spring 60 and also around the thrust member 61 so that these components can be retained radially with proper clearance and are easily movable in axial directions. The spring pressure insert may have portions thereof directed toward the spring and/or to the lead guide tube 2 which function to center the compression spring and/or the pressure insert within the claws. These portions may also function as a contact attachment for the lead guide tube 2.

In order to prevent jamming of the compression spring or of the thrust member or any other structure used to transmit force from the spring, the contact points or areas on the claws should be constructed so as to be non-self-locking. While the bevel surfaces as described above may be used, other forms of pressure edges may be employed, such as for example, where the contact region is formed of two adjacent inclined frames which slide towards each other. The incline of the planes or the bevel surfaces should be such that the axial force exerted by the spring together with the weight of the other movable components of the clamping member is greater than the radial force acting on the jaws of the clamping member. While bevel surfaces at a 45° angle are especially suitable, other structures may be employed as long as there is no possibility of any self-locking between the compression spring and the stop claws and that there is a good releasability at all times when the pencil is changed from writing to non-writing position.

The inclined surface 73 on the sleeve 78 is also constructed so as to be non-self-locking with respect to the balls 47 loosely carried in the clamping member 40. Instead of balls, discs or rollers may also be provided and the surface 73 is preferably provided with a hardened surface so as to resist wear. Because of the conical shape of the surface 73 a relatively large tolerance compensation of the elements is possible when the degree of conicity is relatively small but at the same time provide for a non-self-locking relationship.

In order to maintain the ineffective pressure path of the lead guide tube as short a distance as possible, the lead guide tube and the compression spring as well as the intermediate components including thrust members or pressure inserts be continuously in operative connection with each other. All of these components thus function together in the area of their movement along the axis of the pencil and are provided with such a relationship with each other, particularly axially, that the stop claws engage the contact regions without or with as little play as possible on the contact surface between the lead guide tube and the compression spring, or pressure insert or thrust member, if used.

It follows that the larger the production tolerances, the greater will be the play to be constructed in the area of the contact surfaces between the clamping member and the stop claws, if no other structure is introduced to compensate for such clearances.

Figure 2:
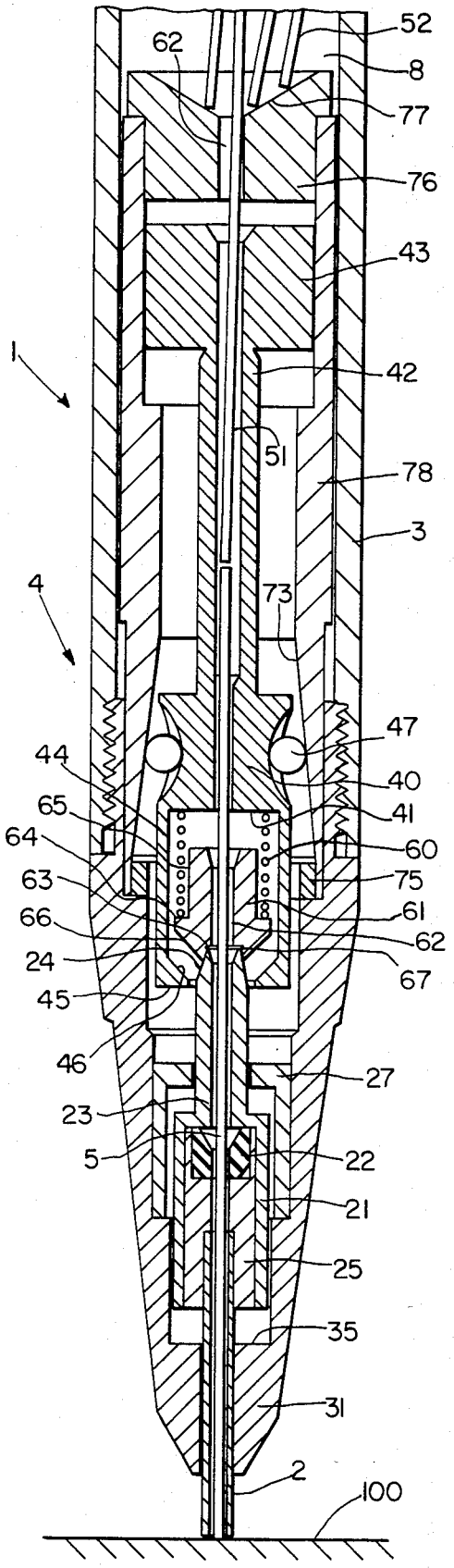
FIG. 2 is a view similar to that of FIG. 1 but of a modification thereof and the pencil shown in the writing position.

In FIG. 2, the pencil 1 is shown in the writing position wherein the lead guide tube 2 and lead 5 are in operative engagement with surface 100 or with any other writing surface as a result of writing pressure applied by the user to the pencil. The sliding insert 21 has been lifted free from the stop shoulder 35 in the writing point 31 since the lead guide tube assembly is moved axially upward. The thrust member 61 is pressed rearwardly against the force of compression spring 60 by means of the contact attachment 23 exerting a force on beveled surface 66. As the clamping member 40 moves rearwardly or into the casing 3, the rollers 47 which slide along surface 73 exert an inwardly directed opposing force on the jaws of the clamping member to secure the lead 5 therein. The insert stop 27 has a bore through which the contact attachment 63 is slidable and guided thereby. The upper end of the contact attachment 23 may be provided with a conical center cone 24.

The insert 61 is provided with a guide attachment 65 and a spring stop 64 for centered mounting and support of compression spring 60 as well as the central passage 62 and in the raised position the thrust member 61 exposes its bevel surface 66. After the pencil is lifted from base 100, the bevel surface 66 will descend to engage pressure stops 46 on claws 45 and the force exerted against the bevel surfaces 46 will cause the jaws of clamping member 40 to move radially outwardly so as to release the lead therefrom.

In FIG. 2, the clamping member 40 is also modified by having its sleeve 42 connected on its upper end to a weight collar 43 which also functions as a slide guide within the sleeve 78 such that the entire clamping structure 4 forms a closed unit which is assembled into the housing 3. In the central passage 62 in the thrust member 61 and in the passage in the closure cap 76 as well as in the enlarged bore of the clamping member 40 and in the lead storage compartment 8 there are assembled successively the lead 5 which is in writing or operative position, the follow-up lead 51 and replacement leads 52 all of which can be used without additional handling.

In the function of the pencil according to the present invention, the pencil is moved into a writing position from a rest position by bringing the point of the pencil into contact with a writing surface or carrying out an actual writing process. Depending on the wear of the lead, the lead guide tube 2 will slide axially into the pencil or into the writing point 31 against the force of compression spring 60 and by overcoming the holding force of the lead brake 22 during writing. The resulting release of the contact areas or by lifting the compression spring 60 or the thrust member 61 from the stop claws 45 and by simultaneously increasing the pressure of the compression spring against the clamping member 40, the clamping member 40 moves axially rearwardly or upwardly as viewed in FIG. 1 and radially inwardly by the action of the conical surface 73 against the balls 47. This rearward axial movement increases the radially directed clamping action of the jaws on the lead until its axial clamping force is greater than the axial holding force of the lead brake 22 so that the lead is retained only by the clamping member 40 and thus can be used or worn down.

During writing, the lead guide tube 2 together with the lead brake 22 slides inwardly of the writing point 31 to a maximum position until the front edge of the lead guide tube 2 is substantially in the same plane with the front end of writing point 31. Then, at the latest when the entire writing operation has been completed, but in practice usually much earlier, the pencil may be lifted from the surface 100 and then placed down again.

After or during lifting of the lead guide tube 2 from the writing surface 100, the lead guide tube 2 will move axially forward because of the axial force transmitted to it by compression spring 60 until the stop 35 is contacted at which time a change from writing to rest position occurs. However, before the lead guide tube rests upon the stop 35, the clamping components of clamping member 40 are moved forwardly toward the writing point and radially outwardly by the force exerted against the stop claws by means of the compression spring 60.

As a result, the clamping force on the lead is removed and the lead is released. Because of the holding force of the lead brake, the lead is then moved forwardly to the writing point 31 in the further course of the axial forward movement of the lead guide tube as a result of which the pencil is again ready to write. Since, according to the present invention, the clamping member 40 is always open when the pencil is in the rest position, the followup lead can easily fall to the clamping member 40 into a butting engagement against the writing lead.

Figure 3:
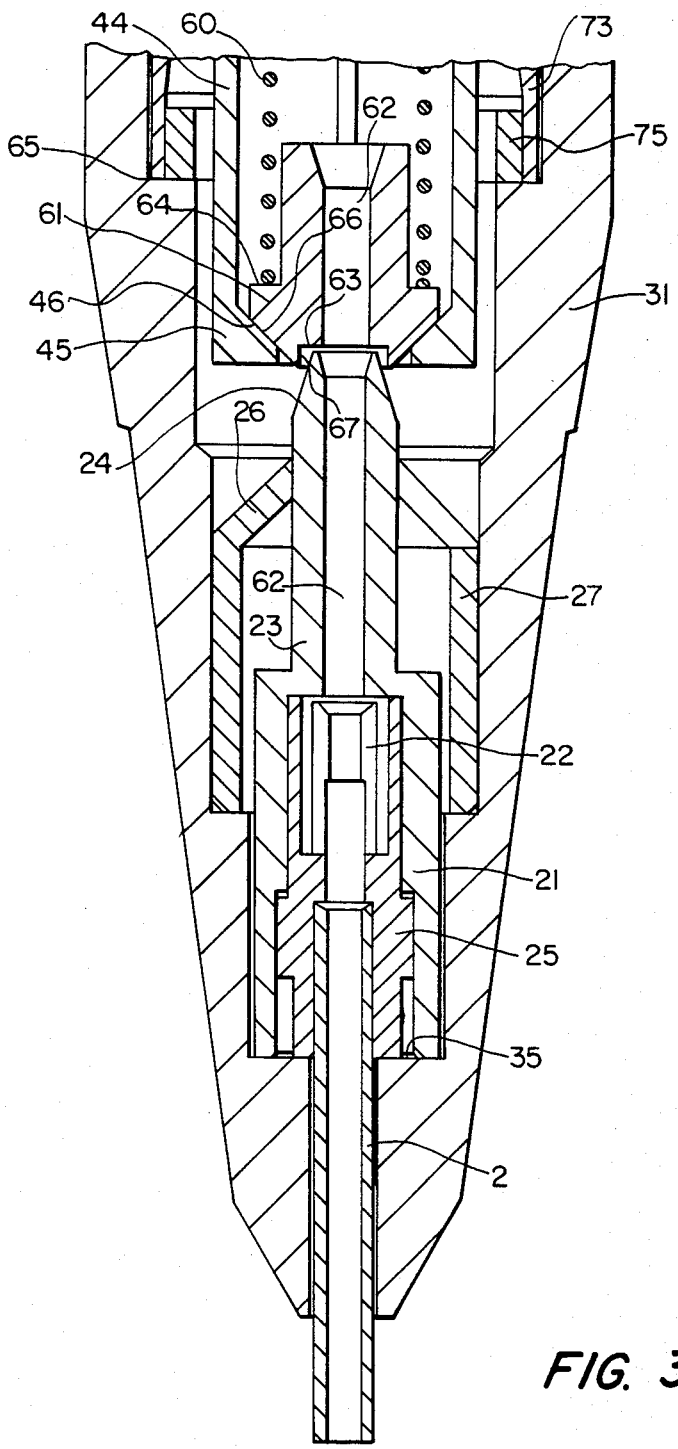
FIG. 3 is a view similar to that of FIG. 1 but in somewhat larger scale and showing a further modification but without a lead therein.

In FIG. 3 there is illustrated a modification in the writing point 31 in which the lead guide tube 2 is anchored within a cylindrical body 25 which at the same time functions as the lead brake 22 and which is surrounded by the sliding insert 21. The insert 21 is provided with a tubular extension 23, the upper end of which is beveled at 24 so as to form a contact surface. As result of this structure, the insert 21 and the cylindrical body 25 both rest upon stop 35 in the rest position of the pencil.

End stop 27 which is secured within the writing point 31 is provided with a slotted sliding brake 26 which engages the outer surface of the lead guide tube 2 in order to provide a braking on the axial sliding movement of the lead guide tube 2. An annular safety member 75 is fastened in a sleeve 78 having a relatively large central opening through which extend the axial arms 44 with their radially inwardly directed stop claws 45.

The bevel surfaces 66 of the thrust member 61 rests upon bevel stop surfaces 46 on the upper faces of claws 45. The thrust member 61 is provided with an annular shoulder 64 upon which rests one end of compression spring 60 which is centered by a cylindrical portion 65. There is a central passage 62 through the cylindrical portion 65 whose diameter is greater than the diameter of the leads, so that the leads can freely fall with clearance to the lead brake 22.

Figure 4:
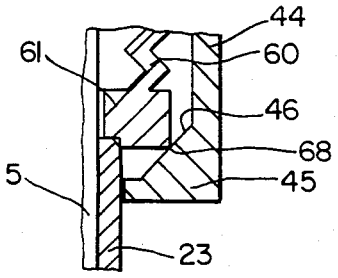
FIGS. 4–7 are longitudinal sectional views of portions of FIG. 1 in larger scale showing several modifications of the structure involving the compression spring, stop claws and lead guide tube.

In FIG. 4, the stop claw 45 is similarly provided with a bevel pressure stop surface 46 which is engageable by a pressure edge 68 on the thrust member 61 constructed as a single unit together with the spring 60. The contact area is thus formed by the pressure edge 68 and bevel surface 46. Lead 5 is positioned in the contact attachment 23 with play or clearance. This structure of a thrust member 61 can be made of a hard but resilient plastic together with compression spring 60.

Figure 5:
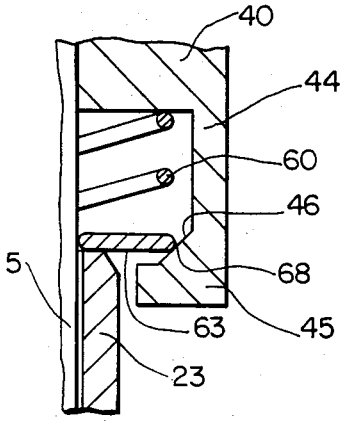

In FIG. 5, a conventional helical compression spring 60 is provided with a pressure edge 68 on a directly formed contact surface 63 upon which the contact attachment 23 is supported. The axial arms 44 extend parallel to the axis of the clamping member 40 and are similarly provided with stop claws 45. Lead 5 is held therein not by the clamping member 40 but by a lead brake which was not shown.

Figure 6:
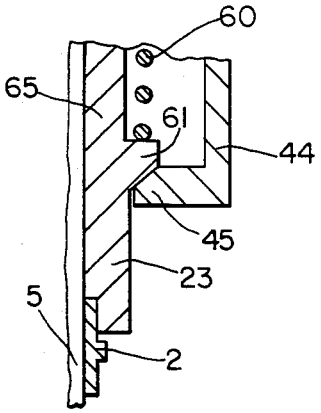

FIG. 6 discloses a thrust member 61 which rests upon a stop claw 45 formed on the end of axial arm 44 and the thrust member is provided with a central cylindrical guide 65 for centering the compression spring 60 as well as with a contact arrangement 23 for directly acting upon the lead guide tube 2.

Figure 7:
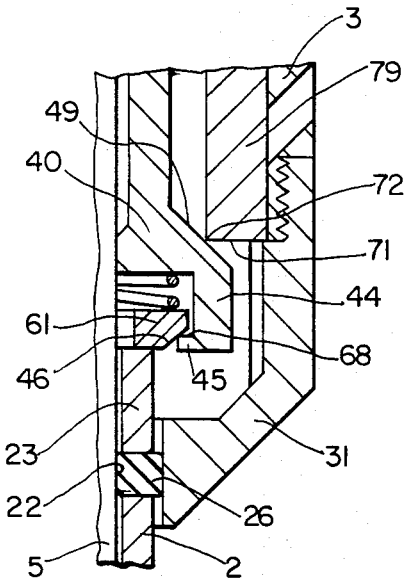

In the modification of FIG. 7, lead 5 is held by a lead brake 22 mounted in the lead guide tube 2 which simultaneously functions as a sliding brake 26 within the writing point 31. The inner end of the lead guide tube 2 acts directly upon a resilient thrust member 61 which has a conical pressure surface 46 resting on pressure edge 68 of stop claw 45 which is annular in shape. The clamping member 40 has an inclined outer conical contact surface 49 which engages contact edge 72 on front end 71 of sleeve 78 assembled within casing 3. Depending on pressure and friction conditions, the angles of inclination of both pressure bevel surfaces can be modified so as to provide a most effective functioning.

Figure 8:
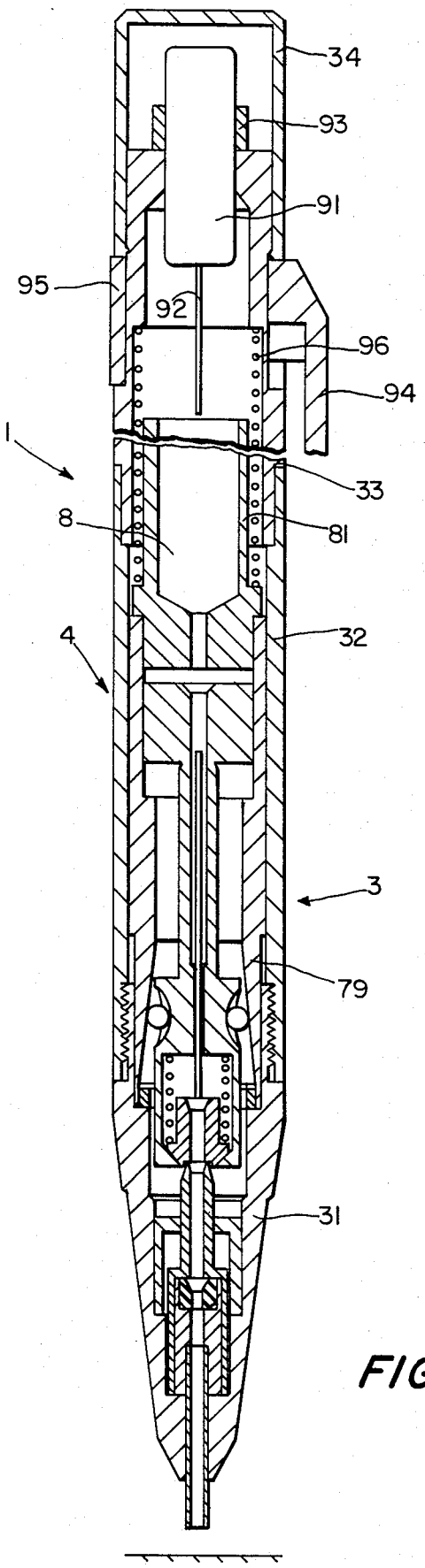
FIG. 8 is a view similar to that of FIG. 1 showing the entire pencil and showing a further modification for additional spring-loading of the lead.

FIG. 8 illustrates a modification wherein the entire clamping device indicated generally at 4 is axially movable in pencil casing 3 against the pressure exerted by a compensating spring 96 is acting against sleeve 78. Spring 96 is positioned around the axially movable tubular chamber 81 which forms the lead storage compartment 8. One end of spring 96 acts upon a shoulder formed on tube 81 and the other end is supported on a shoulder formed on an upper casing component 33. The casing component 33 is connected in a suitable manner with central element 32 of the casing and is also provided with a clip 94 retained by a clip ring 95. The upper end of casing 3 consists of a closed end cap 34 which encloses an eraser 91 from which extends a needle or pin 92 and is surrounded by a sleeve 93. The remaining components of this modification correspond to the structure illustrated in FIG. 2 but it is to be noted that the modification of FIG. 8 is illustrated without lead and in the rest position.

The modification of FIG. 8 has the advantage of keeping axial shearing forces exerting on the lead from becoming excessive because of increased or heavy writing pressure. The entire clamping device 4 is thus capable of axial movement in both directions and is acted upon by a compensating spring whose compressive force is selected as required or can even be separately adjusted by suitable means such as by an adjustable support in the casing.

It has been determined to be particularly advantageous when the compressive force acting axially toward the writing point is less than the counter acting forces of the compression spring and all of the axial movable parts such as, for example, the clamping device 4, sliding tube 81, and sleeve 79. The magnitude of this compressive force can be selectively determined or adjusted as a function of the hardness of the lead or the wear characteristics of the lead.

Figure 9:
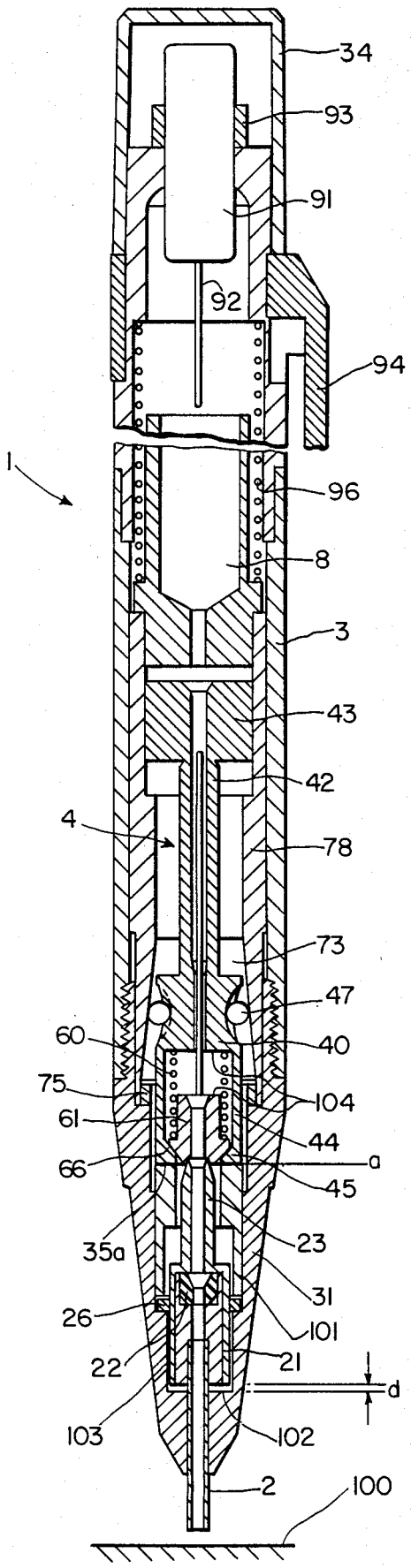
FIG. 9 is a view similar to that of FIG. 8 but showing a modification utilizing a spring-loaded clamping member.

In FIG. 9, there is illustrated a modification pencil which is basically similar to the structure illustrated in FIG. 8 and described above.

Within the writing point 31 there is firmly arranged a cylindrical insert 101 which has a closed end facing upwardly as viewed in FIG. 9 and forming a stop 35*a*.

The cylindrical insert 101 has its lower end engageable with the sliding brake 26 so as to actually position sliding brake 26. The lead guide tube 2 is axially movable in writing point 31 and is mounted within the sliding element 21, the upper end of which is provided with tubular contact member 23 and within which is mounted lead brake 22. The front or lower end of the sliding element 21 is shown in its rest position and is spaced from base 102 of bore 103 by a clearance d since the pencil is lifted from writing surface 100 and the sliding element 21 is held by friction together with lead guide tube 2 by the sliding brake 26. The opening path indicated at a is at this time equal to 0. The space between opposing contact surfaces 104 on the upper end of the thrust member 61 and on front face 41 of clamping member 40 is illustrated in an enlarged manner.

Figure 11:
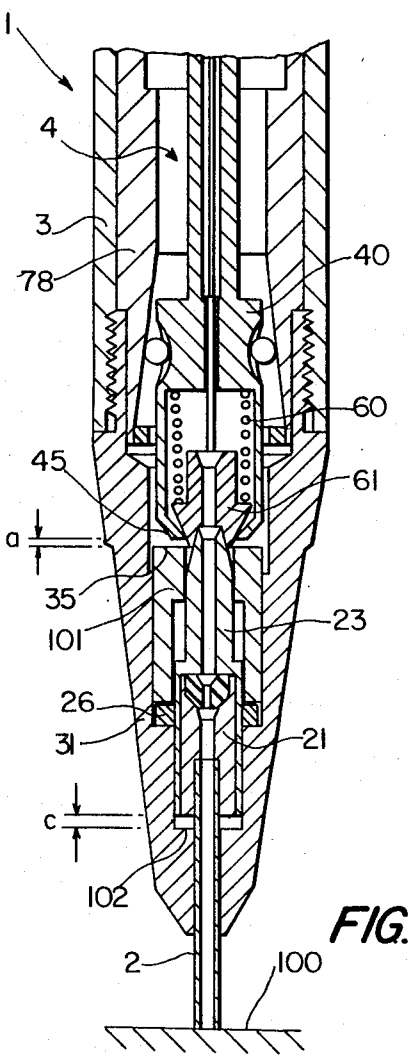
FIG. 11 is a view similar to that of FIG. 10 but showing the pencil in the writing position.
Figure 10:
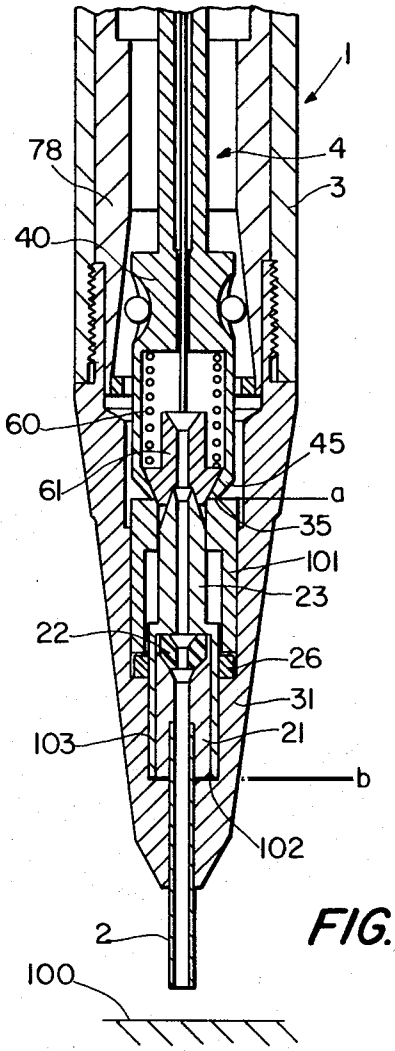
FIG. 10 is a view of the writing point portion of the pencil of FIG. 9 with the pencil in the rest position.

FIGS. 10 and 11 illustrate substantially the same pencil 1 as illustrated in FIG. 9 but without lead in the rest position (FIG. 10) and also in the writing position (FIG. 11).

The base 102 in FIG. 9 to 15 corresponds with stop shoulder 35 in FIGS. 1 to 3.

The changes in position of the axially movable components are seen in FIG. 11. Opening path a is equal to 0 in the rest position as shown in FIG. 10 while in the writing position as seen in FIG. 11, the distance c is formed from the opening path a the tolerance space b and the writing path. In the rest position of the pencil as seen in FIG. 10, the radially movable jaws of the clamping member 40 are open since under the action of compression spring 60 the thrust member 61 moves these clamping jaws radially outwardly as result of the coacting bevel surfaces on the stop claws 45 and these claws are moved axially downwardly until they abut the stop 35*a*. The maximum distance of opening path a is thus particularly dependent upon the structure of the clamping member 40 and the size and nature of the lead but should be as small as possible. In the rest position as seen in FIG. 10, opening path a is equal to 0.

When the pencil 1 is lifted from the writing surface 100, the sliding insert 21 together with lead guide tube 2 are moved forwardly toward the writing point 31 as result of force exerted by the thrust member 61 and contact tube 23 until the clamping member 43 and/or thrust member 50 rest upon the down stop 35*a*. In this manner, the lead is moved forwardly or downwardly under the effect of the radial holding force of lead brake 22.

As soon as the axial forward movement of clamping member 40 or of thrust member 61 is completed such that a is equal to 0, the axial forward movement of the sliding insert 21 or of the lead guide tube 2 will also be completed since the lead guide tube 2 is held firmly by radial forces exerted by the sliding brake 26.

Accordingly, the axial force exerted by compression spring 60 must be greater than the axial holding force of sliding brake 26. On the other hand, however, the axial holding force of sliding brake 26 must be greater than the axial weight of lead guide tube 2 together with sliding insert 21 and the weight of the leads positioned above each other in order to brake these components effectively, in the event that the spring force is no longer effective. The free axial space remaining under these conditions between the base 102, slide bore 103 and the front surface of sliding insert 21 can thus be practically selected as any desired tolerance b or can be constructed relatively large as a result of production tolerances. A functionally ineffective slide path of the lead guide tube 2 which must be overcome at the beginning of the writing operation no longer occurs under the action of the sliding brake 26. In this rest position, the lead is held only by the holding force of lead brake 22 since the clamping member 40 is open. As may be seen in FIG. 11, upon touching the point of the pencil to writing surface 100, lead guide tube 2 moves axially into the writing point 31 against the force of spring 60 so that the clamping member 40 closes and holds the lead firmly therein with respect to axially exerted writing pressure. The axial rearward movement of clamping member 40 occurs as a result of the contact tube 23 exerting a force against thrust member 61 and spring 60.

In the situation when writing or drawing of lines as in an instrument are terminated, these operations are performed without lifting the pencil from the surface 100, lead guide tube 2 will slide into the writing point 31 by overcoming the force of spring 60 and the axial braking force of lead brake 22 and sliding brake 26 to an inner stop or up to the front edge 105 of the writing point 31 which also touches the writing surface 100 and is thus located on a horizontal plane with the point of lead guide tube 2. Sleeve 78 of clamping device 4 can thus be arranged in pencil casing 3 to be stationary or actually movable.

Figure 12:
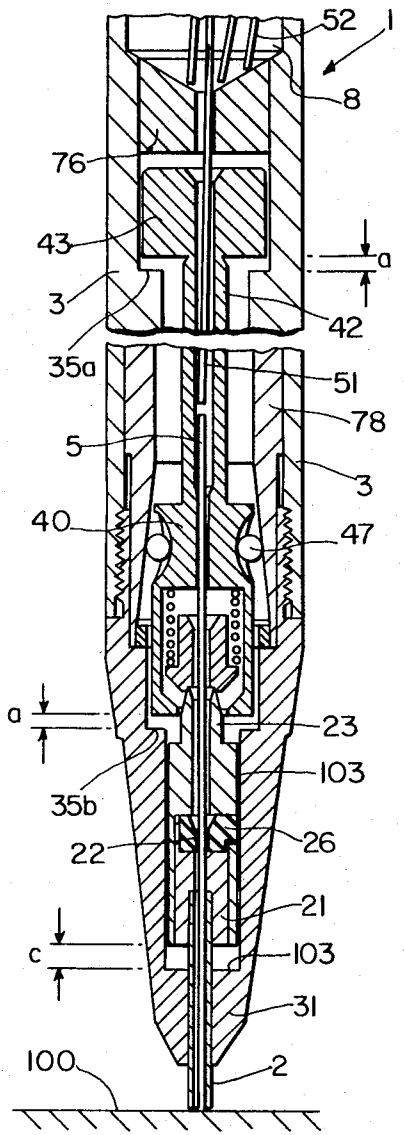
FIG. 12 is a view similar to that of FIG. 10 and showing still another modification.

In the modification of FIG. 12, drop stop 35*a* is formed directly on an inner surface of casing 3 as shown in the upper half of the drawing or as stop 35*b* on the inner surface of writing point 31 in the lower half of the drawing. Sliding brake 26 is combined or formed integrally with lead brake 22 and operates directly on the wall of the bore 103. A radial portion of sliding brake 26 extends radially outwardly over the sliding insert 21.

The pencil 1 is shown in the writing position in which lead guide tube 2 and lead 5 rest on writing surface 100. Distance c is formed from the tolerance b, opening path a and the writing path already followed for the effective axial slide path of the sliding insert 21. The distance c is defined between the base 102 of the bore 103 and the front surface of sliding insert 21.

It is to be noted that FIG. 12 shows in detail two different constructions of the pencil casing 3.

Figure 13:
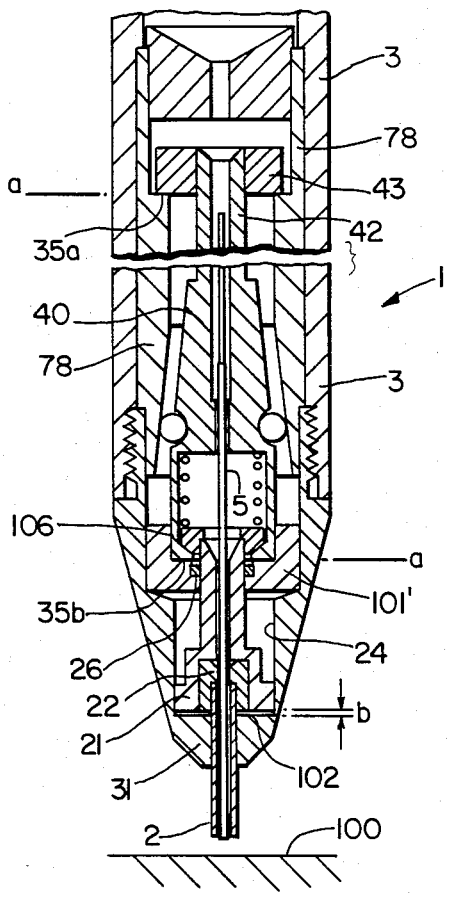
FIG. 13 is a view similar to that of FIG. 10 and another modification with the pencil in the rest position.

FIG. 13 similarly discloses two different modifications in the rest position wherein in the upper portion thereof the stop collar 43 is mounted upon clamp member shaft 42 and rests on a drop stop 35*a* formed on an inner wall of the sleeve 78 mounted in casing 3. In the lower portion of FIG. 13, the front face of clamping member 40 rests on a stop 35*b* which is formed at the base of a recess 106 formed in fixed insert 101'. The insert 101' is firmly mounted within writing point 31 and is provided with an O-ring as a sliding brake 26 which acts against the peripheral surface of contact tube 23 mounted on the sliding insert 21. The space between the front surface of sliding insert 21 including lead brake 22, lead guide tube 2 and base 102 of bore 103 defines the tolerance b which should be present in any case to a small extent so as not to impair the reliable functioning of pencil 1.

In the rest position, writing position 100 is not touched by the point of the lead guide tube 2 and/or lead 5, and the clamping member 40 or its stop collar 43 rest on drop stop 35*a* so that the opening path a is equal to 0. The wall of the bore or recess 106 can at the same time function to limit the radial opening path of the jaws on clamping member 40.

Figure 14:
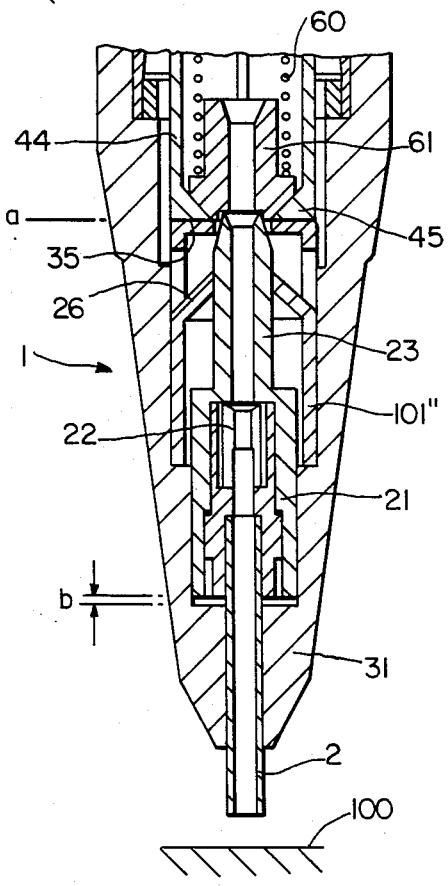
FIG. 14 is a view similar to that of FIG. 10 and showing still another modification.

In FIG. 14, pencil 1 is provided with an insert 101" mounted in writing point 31 on which the sliding brake 26 is formed directly by partial punchouts, radial cuts, or similar projections as may be seen in the drawing. The sliding brake 26 thus exerts radial pressure and an axial holding force or an axial braking force on the contact tube 23 which is directly formed on the sliding insert 21 within which is retained lead brake 22 and the lead guide tube 2.

The opening path a is equal to 0 since the pencil does not rest on the writing surface 100 and clamping member 40 (not shown in this drawing) or their stop claws 45 rest on the drop stop 35*b*. Front face of thrust member 61 which is acted upon by spring 60 similarly rests directly on stop 35*b* so that no further axial force acts on the writing insert 21. Tolerance b is maintained by the effect of the sliding brake 26.

Figure 15:
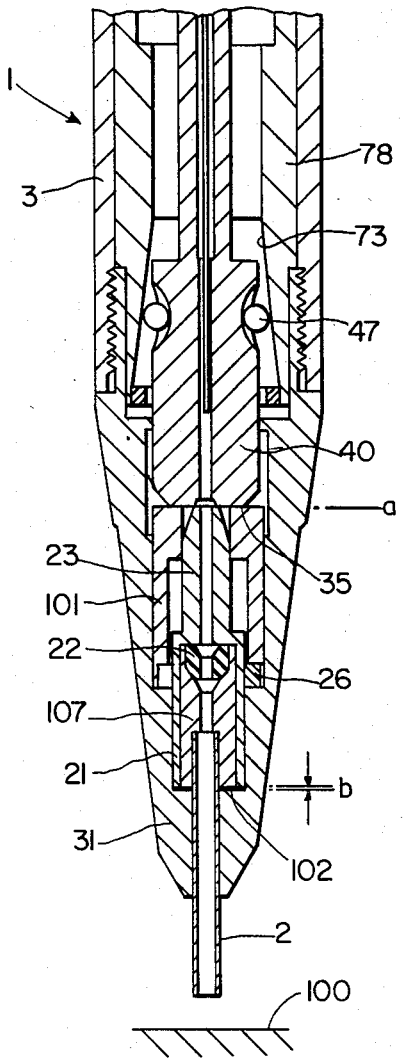
FIG. 15 is a view similar to that of FIG. 10 and showing still another modification.

In FIG. 15, the clamping member 40 is constructed as a massive dropping body so that a spring arrangement is unnecessary. The sleeve 78 may be either axially movable or stationary in casing 3 and operates by its conical surface 72 acting upon clamping rollers 47 to radially tighten and radially hold onto clamping member 40 and onto the lead 5 carried therein but not shown in the drawing.

The front surface of clamping member 40 rests on the stop 35*b* so that opening path a is also equal to 0 in this application since pencil 1 does not touch writing surface 100. Sliding brake 26 is mounted within insert 101 to establish a tolerance clearance of b. The sliding insert 21 has a contact tube 23 and a lead brake 22. Also within insert 21 is a mounting tube 107 within which the lead guide tube 2 is mounted.

Because of the action of sliding brake 26, it is immaterial as to the size of the tolerance b between base 102 and the front face of sliding insert 21. Since the insert 21 and also the lead guide tube 2 do not move axially the distance of the tolerance b in the case of an effective sliding brake 26. Without the sliding brake, lead guide tube 2 would not move forward under its own weight. At the beginning of writing, the tolerance b would then result in a non-functioning sliding path, a short idle stroke which would most likely be perceived by the user as being unpleasant. The result is similar if opening path a of clamping member 40 is not limited to a maximum dimension. Such an effective limitation is achieved by the drop stop 35*b*.

If the lead guide tube 2 is constructed without a sliding insert 21 because of the sliding brake, an axial end stop at the front could most likely be eliminated. This is particularly advantageous if lead guide tube 2 is made interchangeable so as to accommodate different leads.

If the axial braking action of sliding brake 26 is less than that of the lead brake 22, then forward movement of the sliding insert 21 as result of the radial holding force of lead brake 22 and overcoming of the axial braking action of sliding brake 26 will move the lead forwardly.

Should it be desired that the lead project just beyond the point of lead guide tube 2, it is advantageous if the axial braking action of sliding brake 26 is greater than the axial braking action of lead brake 22. The result will be that upon actual forward movement, the lead guide tube 2 or sliding insert 21 are somewhatly restrained or held back while the lead moves further forward by overcoming the axial braking force of lead brake 22.

With the construction as described in the preceding paragraph, it would be particularly advantageous that the entire clamping device 4 such as illustrated in FIG. 9 be acted upon by compensating spring 96 so that the axial pressure force of this spring 96 is overcome at least partially with effective writing pressure or the like. Upon the release of the writing pressure or with the lifting of pencil 1 from writing surface 100, the clamping device 4 with lead therein will slide forwardly under the pressure of compensating spring 96 by the amount of lead projection which is limited by contact surface 104 shown in FIG. 9 held in the desired relationship against the axial pressure of spring 60.

The axial braking force of lead brake 22 must also be overcome.

When the contact surfaces 104 are located on clamping member 40 and on thrust member 61 and engage each other, lead guide tube 2 or the slide insert 21 firmly connected with it are forcibly moved forward by the axial force of spring 96 until reaching the rest position. The result is a portion of the lead projecting from lead guide tube 2 whose axial length can be predetermined and selected by the space between the contact surfaces 104.

Generally, the lead projects from the lead guide tube about 0.5 to 1.2 mm. Until the contact surfaces 104 engage each other, sliding brake 26 retains the lead guide tube 2 or the slide insert 21 firmly by friction. The axial holding force of slide brake 26 is overcome and lead guide tube 2 and insert 21 move forwardly together with the lead until clamping member 40 or its stop collar 43 rest against drop stop 35*a* or 35*b* and the movable components of the pencil have reached their rest position.

The design of sliding brake 26 may comprise, for example, a slotted radially spring-loaded ring, resilient transverse elements or a radial attachment. Simple knobs or projections may also be formed in the bore 103 in the writing tip 31 or on the sliding insert 21.

The pencil according to the present invention can be used as an instrument for writing or the taking of notes by hand. By adaptation of the casing to the mount of an automatic writing or drawing machine, such as a plotter, registering, or some other recording instrument, or by some other adaptation of the mount, the pencil can also be used as a writing insert for this type of equipment.

It will be understood that this invention is susceptible to modifications to adapt it to different usages and conditions and, accordingly, it is desired to comprehend such modifications within this invention as may fall within the scope of the appended claims.

What is claimed is:

1. An automatic lead advancing device for a mechanical pencil comprising an axially movable lead guide tube, an axially movable clamping member having a central passageway there through for lead and having radially movable components to clamp the lead therein, a plurality of arms projecting axially from a face of said clamping member directed to a writing point of the pencil, inwardly directed stop claws on the ends of said axially projecting arms, a compression spring within said axial arms and having one end acting upon said face of said clamping member and another end acting against means operatively connected to said lead guide tube, and means between said compression spring and said stop claws for transmitting both radial and axial forces through said axially projecting arms and said stop claws to said clamping member whereby the clamping member is in an unclamping position with respect to a lead therein when the pencil is in a non-writing position.

2. An automatic lead advancing device as claimed in claim 1 wherein said means for transmitting both radial and axial forces comprises a thrust member between said compression spring on one hand and said lead guide tube and said stop claws on the other hand.

3. An automatic lead advancing device as claimed in claim 2 and further comprising a tubular contact member extending from said lead guide tube toward said clamping member and having a contact area engageable with one of said compression spring and said thrust member.

4. An automatic lead advancing device as claimed in claim 3 wherein said contact area is non-self-locking with respect to said compression spring or said thrust member.

5. An automatic lead advancing device as claimed in claim 3 wherein said contact area comprises a bevel surface.

6. An automatic lead advancing device as claimed in claim 5 wherein said compression spring has a force transmitting edge portion engageable with said bevel surface in the non-writing position of the pencil.

7. An automatic lead advancing device as claimed in claim 5 wherein said stop claws have a first bevel surface engageable with a second bevel surface on said thrust member, said co-acting bevel surfaces being such that the axial force exerted by said compression spring and axially movable components of said clamping member is greater than the radial force acting upon said stop claws.

8. An automatic lead advancing device as claimed in claim 1 and further comprising means co-acting between said clamping member and an interior portion of a casing for the pencil for urging said clamping member radially inwardly to clamp a lead therein when said lead guide tube is moved axially inwardly of the casing upon applying a writing pressure to the pencil, the clamping action of the clamping member being greater than the axial holding force of a lead brake within a writing point of the casing.

9. An automatic lead advancing device as claimed in claim 8 and further comprising stop means within said writing point for stopping the axial movement of the lead guide tube under the force exerted by the compression spring when the pencil is lifted from the writing position to a non-writing position 10. An automatic lead advancing device as claimed in claim 1 and further comprising a slideable sleeve within a casing of the pencil and said clamping member being mounted within said sleeve, a second spring acting upon said slideable sleeve in a direction toward the writing point of the pencil, and second stop means within said casing for limiting the movement of said slideable sleeve toward the writing point.

11. An automatic lead advancing device as claimed in claim 10 wherein the force exerted by said second spring is greater than the axial force exerted by said compression spring and of all axially movable components together.

12. An automatic lead advancing device as claimed in claim 1 wherein said pencil has a writing point, and means within said writing point for stopping axial movement of said clamping member toward said writing point.

13. An automatic lead advancing device as claimed in claim 12 wherein said means for stopping axial movement comprises an inner portion of the writing point.

14. An automatic lead advancing device as claimed in claim 12 wherein said means for stopping axial movement comprises an end of a cylindrical sleeve insert disposed within said writing point.

15. An automatic lead advancing device as claimed in claim 14 and further comprising sliding brake means within said writing point for acting against said lead guide tube to limit axial movement thereof, said cylindrical sleeve insert fixing said sliding brake means in axial position.

16. An automatic lead advancing device as claimed in claim 12 wherein said means for stopping axial movement is disposed on a sleeve within a casing of the pencil.

17. An automatic lead advancing device as claimed in claim 12 wherein said means for stopping axial movement is disposed on a surface of a casing of the pencil.

18. An automatic lead advancing device as claimed in claim 12 and further comprising sliding brake means within said writing point for acting against said lead guide tube to limit axial movement thereof lead brake means within the writing point for braking the axial movement of a lead therein, the axial braking action of said sliding brake means being less than the axial braking action of said lead brake means.

* * * * *